US005592208A

United States Patent [19]

Shinozaki et al.

[11] Patent Number: 5,592,208

[45] Date of Patent: Jan. 7, 1997

[54] PRINTING METHOD AND A PRINTING APPARATUS FOR CARRYING OUT THE SAME

[75] Inventors: Kenji Shinozaki; Hideki Hirano; Koichi Kawasumi; Nobutoshi Asai, all of Kanagawa; Hidemi Tomita, Tokyo; Shuji Sato, Kanagawa; Masanori Ogata, Saitama; Hiroyuki Shiota, Chiba, all of Japan

[73] Assignee: Sony Corporation, Tokyo, Japan

[21] Appl. No.: 188,841

[22] Filed: Jan. 31, 1994

[30] Foreign Application Priority Data

| | | | |
|---|---|---|---|
| Jan. 29, 1993 | [JP] | Japan | 5-034891 |
| Apr. 23, 1993 | [JP] | Japan | 5-120924 |
| Jul. 16, 1993 | [JP] | Japan | 5-199004 |

[51] Int. Cl.[6] ..... B41J 2/325; B41J 2/435

[52] U.S. Cl. ..... 347/171; 347/217; 347/224

[58] Field of Search ..... 400/197, 198, 400/199, 200, 201, 202, 202.2, 202.3, 202.4; 347/224, 171, 217; 503/227

[56] References Cited

U.S. PATENT DOCUMENTS

| | | | |
|---|---|---|---|
| 3,978,247 | 8/1976 | Braudy et al. | 427/43 |
| 4,414,555 | 11/1983 | Becker | 400/198 |
| 4,598,302 | 7/1986 | Swidler et al. | 400/198 |
| 4,772,582 | 9/1988 | DeBoer | 503/227 |
| 4,976,986 | 12/1990 | Akutsu et al. | 400/197 |

FOREIGN PATENT DOCUMENTS

| | | | |
|---|---|---|---|
| 257633-A1 | 2/1988 | European Pat. Off. . | |
| 440236-A2 | 7/1991 | European Pat. Off. . | |
| 0104786 | 6/1983 | Japan | 400/198 |

*Primary Examiner*—Huan H. Tran
*Attorney, Agent, or Firm*—Hill, Steadman & Simpson

[57] ABSTRACT

An ink sheet (3) is wound around rollers (6), and a recording sheet (4) is placed with a space (d) between the ink sheet (3) and the recording sheet (4) and is advanced. The thickness of the space (d) is a value in the range of 1 to 100 μm. The ink sheet (3) is irradiated with a laser beam (L) emitted by a laser (5) to transfer the dye contained in a dye layer formed on the ink sheet (3) from the ink sheet (3) to the recording sheet (4) for printing. The dye layer of the ink sheet (3) is replenished with the dye (30, 30A) heated and fused by a heater (9) by a dye supply unit (7) at a position other than a position where the ink sheet (3) is irradiated with the laser beam (L). Since the ink sheet and the recording sheet are held with the space (d) having a thickness in the range of 1 to 100 μm, the dye once transferred to the recording sheet is not transferred from the recording sheet to the ink sheet, so that a clear picture having a comparatively high density can be printed. Since the dye layer of the ink sheet is replenished with the dye, the ink sheet can be repeatedly used, so that no waste is produced.

7 Claims, 12 Drawing Sheets

PRINTING METHOD AND A PRINTING APPARATUS FOR CARRYING OUT THE SAME

BACKGROUND OF THE INVENTION

1. Field of the Invention

The present invention relates to a printing method and a printing apparatus for carrying out the same and, more specifically, to a thermal printing method and a thermal printing apparatus for carrying out the same.

2. Description of the Related Art

The recent progressive development of color image transmission and recording by television cameras, television systems and computer graphic systems have sharply increased need to print color images in color pictures on recording media, and color printers of various printing systems have been developed and applied to various fields.

A color printer of a thermal dye-transfer printing system, which is one of the previously proposed color printers of various printing systems, presses an ink sheet formed by coating a sheet with a layer of ink prepared by dispersing a dye in a high density in a binder resin and a recording medium, such as a recording sheet formed by coating a sheet with a dye-accepting resin that accepts the dye, closely against each other, applies heat to the ink sheet according to image information with a thermal print head placed on the ink sheet or with a laser beam emitted by a laser light source so that a quantity of the dye proportional to the quantity of heat applied to the ink layer is transferred from the ink sheet to the recording medium. A thermal sublimable dye printing method employing a sublimable dye or a heat-diffusible dye can be carried out by a printing apparatus having a comparatively small size and requiring simple maintenance service. A printer of the so-called thermal printing system, which prints a full-color picture having continuous gradation corresponding to the amount of heat energy by repeating the foregoing printing cycle for image signals representing images of the three subtractive primaries, namely, yellow, magenta and cyan, has a capability of immediately printing a color picture in a high picture quality comparable to that of silver salt photographs.

FIG. 17 is a schematic front view of an essential portion of a thermal printer of such a thermal printing system. A thermal print head 91 is disposed opposite to a platen roller 93. An ink sheet 92 formed by coating a base film 92*b* with an ink layer 92*a*, and a recording sheet 100 formed by coating a paper sheet 100*b* with a dyeing resin layer 100*a* are held between the thermal print head 91 and the platen roller 93 and pressed against the platen roller 93 by the thermal print head 91. The platen roller 93 is rotated to feed the ink sheet 92 and the recording sheet 100. Portions of the ink layer 92*a* are heated locally and selectively by the thermal print head 91 to transfer the ink, i.e., a printing material, contained in the ink layer 92*a* to the dye-accepting resin layer 100*a* of the recording sheet in dots for printing. Generally, such a thermal printer is of a line printing system provided with an elongate thermal print head disposed with its length extending perpendicularly to the direction of feed of the recording sheet.

The ink sheet employed in the foregoing conventional thermal sublimable dye printing method is a throw-away ink sheet formed by coating a base sheet, such as a polyester film, with a dye layer of a mixture of a dye and a binder resin having a dye-to-resin weight ratio of about 1:1, having a thickness on the order of 1 μm. Therefore, the use of this ink sheet entails problems in resources conservation and environmental protection. To improve the utilization of such an ink sheet by repeatedly using the same, there have been proposed, for example, a dye layer regenerating method which replenishes the used dye layer with the dye, a multidye layer forming method which forms a multidye layer consisting of a plurality of laminated dye layers, and a relative speed control method which controls the ink sheet feed speed relative to the recording sheet feed speed to increase the amount of prints which can be printed with a unit length of the ink sheet.

All the conventional thermal printing methods press the dye layer of the ink sheet against the dye-accepting layer of the recording sheet and heat the dye layer of the ink sheet. For example, when printing a color picture by the conventional thermal printing method, an yellow ink sheet is superposed on a recording sheet with the yellow dye layer thereof in contact with the dye-accepting layer of the recording sheet and the yellow ink sheet is heated to form a yellow picture on the recording sheet, a magenta ink sheet is superposed on the recording sheet with the magenta dye layer thereof in contact with the dye-accepting layer of the recording sheet and the magenta ink sheet is heated to superpose a magenta picture and the yellow picture on the recording sheet, a cyan ink sheet is superposed on the recording sheet with the cyan dye layer thereof in contact with the dye-accepting layer of the recording sheet and the cyan ink layer is heated to superpose a cyan picture, the yellow picture and the magenta picture on the recording sheet, and, when need be, a black ink sheet is superposed on the recording sheet with the black ink layer thereof in contact with the dye-accepting layer of the recording sheet and the black ink sheet is heated to superpose a black picture, the yellow picture, the magenta picture and the cyan picture on the recording sheet to form a color picture.

Thus, the conventional thermal printing method prints pictures respectively having different colors successively by pressing a dye layer having a color different from those of the previously printed pictures against the previously printed pictures when printing a color picture. Therefore, it occurs sometimes that the dyes previously printed on the recording sheet are transferred from the recording sheet to the dye layer of an ink sheet for printing the next picture to deteriorate the picture quality and to contaminate the dye layer of the ink sheet for printing the next picture. When the ink sheet is used repeatedly, the contamination of the dye layer thereof is a significant problem.

OBJECT AND SUMMARY OF THE INVENTION

The present invention has been made in view of the foregoing problems in the prior art and it is therefore an object of the present invention to provide a printing method capable of being carried out without producing any waste, such as used ink sheets, by a printing apparatus capable of operating at a high thermal efficiency and having a small, lightweight construction.

Another object of the present invention is to provide a printing apparatus capable of operating at a high thermal efficiency without producing any waste, such as used ink sheets, and having a small, lightweight construction.

The inventors of the present invention made zealous studies of thermal printing and have successfully made the present invention. According to the present invention, a full-color picture is formed by repeating a printing cycle having steps of disposing a recording medium having a dye-accepting layer opposite to a printing unit having a fusible dye layer with a minute space therebetween, and selectively evaporating or sublimating the dye stored on the printing unit by a suitable heating means, such as a thermal print head or a laser, to transfer the dye through the minute space from the printing unit to the recording medium so that a picture of one of the three subtractive primaries, i.e., yellow, magenta and cyan, having continuous gradation is formed on the recording medium for image signals representing separate images of the three subtractive primaries.

Since the dye contains little binder resin, the dye can be fed continuously to the printing unit as the dye is consumed for printing by letting the fused dye flow from a dye tank into the printing unit or by continuously moving a suitable base sheet coated with the dye into the printing unit, and the printing unit does not produce used ink sheets.

When an ink Sheet having a binderless dye layer is used, the fused dye spreads over the surface of the recording sheet to spoil the clearness of the printed picture. The fused dye is caused to spread by the surface tension of a nonheated portion of the binderless dye layer greater than that of the heated portion of the binderless dye layer. Such undesirable spread of the fused dye can be effectively prevented by adding a surface active agent to the dye to reduce the surface tension of the fused dye.

When carrying out a thermal dye-sublimation printing method, the temperature of the heating medium for heating the dye must be considerably high to sublimate the dye at a sufficiently high rate. However, nothing about the boiling point of the dye is taken into consideration by the conventional thermal dye-sublimation printing method. This problem can be solved by using a dye having a boiling point not higher than the decomposition point.

The present invention provides a printing method which uses a heating medium supporting printing materials and capable of heating the printing materials by applying heat generated by a heat source to the printing materials, comprising: holding the printing materials and a recording medium with a space having a thickness in the range of 1 to 100 μm therebetween; and heating the printing materials by the heating medium to transfer the printing materials to the recording medium. It is desirable to heat portions of the dyes supported on the heating medium by irradiating the portions of the dyes selectively according to image signals with light. A full-color picture can be printed when the heating medium supports a plurality of dyes differing from each other in color. It is desirable to replenish the heating medium with dyes by a dye supply means to use the heating medium repeatedly. It is desirable to replenish the heating medium with the dye at a position other than a position where the dyes are irradiated with light. It is desirable that the dyes are heated when the same are supplied to the heating medium by the dye supply means, and the dyes do not contain any binder. It is still more desirable that a surface active agent is added to the dye, the surface active agent is an anionic surface active agent, and the surface active agent content of the dye layer is in the range of 0.001 to 10% by weight. It is still more desirable that the printing materials are gasified or sublimated so that the printing materials are transferred through the space between the printing materials and the recording medium to the recording medium for printing, each of the printing materials has a boiling point not higher than a temperature at which the same is decomposed, and each of the dyes as the printing materials has a boiling point in the range of 50° to 600° C. and, it is further desirable that each of the dyes has a boiling point in the range of 250° to 450° C.

The present invention provides a printing apparatus comprising a heating medium, and a heating means for heating the printing materials, and capable of carrying out the foregoing printing method.

According to the present invention, a printing material held by a heating medium, and a recording medium are held with a space having a thickness in the range of 1 to 100μm, and the printing material is heated by the heating medium to transfer the printing material from the heating medium to the recording medium. Therefore, the present invention has the following effects.

Since the printing material is separated from the recording medium, the printing material need not be carried by a carrying member. Therefore, the carrying member and the residual printing material remaining on the carrying member after printing need not be disposed of as waste. Since the printing apparatus need not be provided with any means for holding the printing material and the recording medium in contact with each other, the printing apparatus can be formed in a comparatively small, lightweight construction.

When a plurality of printing materials are used for printing a multicolor picture by superposing a plurality of monochromatic color pictures of the plurality of printing materials, the previously printed printing material will not be transferred from the recording medium to the next printing material and hence the next printing material will not be contaminated.

Since the thickness of the space between the printing material and the recording medium is 1 μm or greater, the foregoing effects can be surely secured. Since the thickness of the space is 100 μm or smaller, pictures can be printed clearly in a comparatively high print density.

BRIEF DESCRIPTION OF THE DRAWINGS

The above and other objects, features and advantages of the present invention will become more apparent from the following description taken in connection with the accompanying drawings, in which:

FIG. 1(*b*) is an enlarged view of a portion of the printing apparatus of FIG. 1(*a*);

FIG. 3(*b*) is a sectional view taken on line IIIb—IIIb in FIG. 3(*a*).

FIG. 8(*b*) is an enlarged sectional view of the same recording chip charged with a dye;

DESCRIPTION OF THE PREFERRED EMBODIMENTS

Figure 1A:
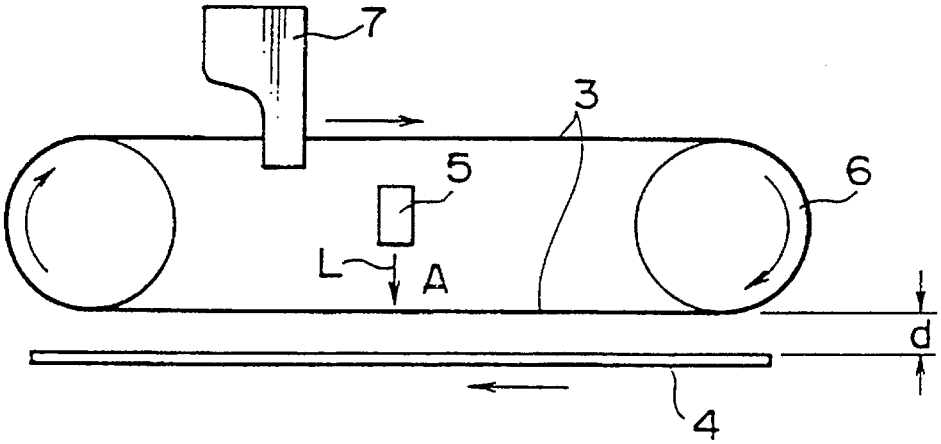
FIG. 1(*a*) is a schematic front view of an experimental printing apparatus in accordance with the present invention.

A printing method in accordance with the present invention holds a printing medium and a recording medium with a space having a thickness in the range of 1 to 100 μm, preferably, in the range of 2 to 50 μm, therebetween to transfer a dye from the printing medium to the recording medium. Reverse transfer, in which the dye transferred from the printing medium to the recording medium is transferred from the recording medium to the printing medium, will occur if the size of the space is less than 1 μm, and the dye of the printing medium cannot be satisfactorily transferred from the printing medium to the recording medium if the size of the space is greater than 100 μm. Since the printing medium and the recording medium are spaced apart by such a space, thermal energy supplied to the printing medium for printing is not transmitted to the recording medium and hence the dye previously printed on the recording medium is not heated and, consequently, the reverse transfer of the dye, i.e., the transfer of the dye from the recording medium to the printing medium, which is undesirable particularly when printing a color picture, does not occur. Since the thermal energy supplied to the printing medium is not transmitted to the recording medium, the dye layer of the printing medium can be concentratedly heated, which enables printing a sharp picture. A printing method of the present invention having those advantages is particularly suitable for printing a color picture by using a plurality of dye layers.

The printing medium and the recording medium may be held with the given space therebetween by any suitable means. For example, when a thermal print head is employed for heating the printing medium, the dye-accepting layer of the recording medium may contain beads to make the surface of the dye-accepting layer irregular so that the space having the given size in the range of 1 to 100 μm is formed between the dye layer of the printing medium and the recording medium when the thermal printing head is pressed against the dye layer of the printing medium. For example, a dye layer, i.e., the dye layer of the printing medium, may be formed so that the same sinks beneath the surface of the heating medium.

The composition of the printing method of the present invention may be the same as that of the conventional thermal printing method except for securing a given space between the printing medium and the recording medium, and the printing method of the present invention may employ printing materials, heating means for heating the printing materials, and a recording medium which are employed in carrying out the conventional thermal printing method. For example, a printing medium having a dye layer containing a dye and a binder or a binderless dye layer may be used. The printing method of the present invention, similarly to the conventional printing method, may use a thermal print head or a laser beam for heating the printing medium. It is preferable to use a laser beam capable of instantly applying thermal energy in a high energy density to the dye layer of the printing medium to transfer the dye from the dye layer through the space to the recording medium. When a laser beam is used for heating the dye layer, it is preferable to use a heating medium containing a substance that generates heat upon the absorption of the laser beam, such as carbon black or platinum black, or a heating medium provided with a thin layer of a substance that generates heat upon the absorption of the laser beam, such as a cobalt-nickel alloy.

It is preferable to regenerate the dye layer of the printing medium to use the printing medium repeatedly. The printing method of the present invention is particularly advantageous for repeatedly using the printing medium by regenerating the dye layer of the same. Transfer of the dye of the dye layer of the printing medium from the printing medium to the recording medium and the regeneration of the dye layer of the printing medium can be achieved by various means.

Means for transferring the dye of the dye layer of the printing medium from the printing medium to the recording medium and means for regenerating the dye layer of the printing medium will be described hereinafter on an assumption that the printing medium is a printing tape and a laser beam is used as heating means.

Figure 3A:
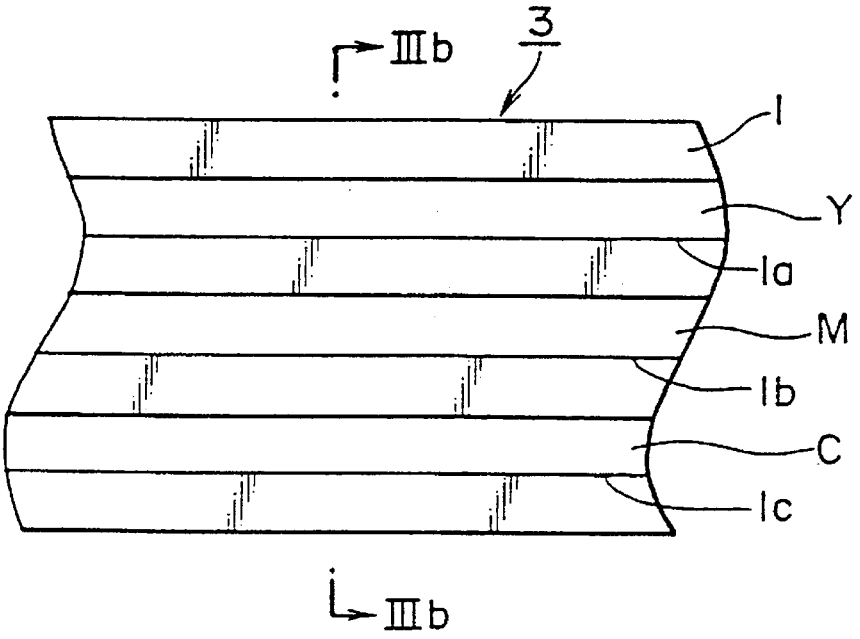
FIG. 3(*a*) is an enlarged plan view of an experimental ink sheet.
Figure 3B:
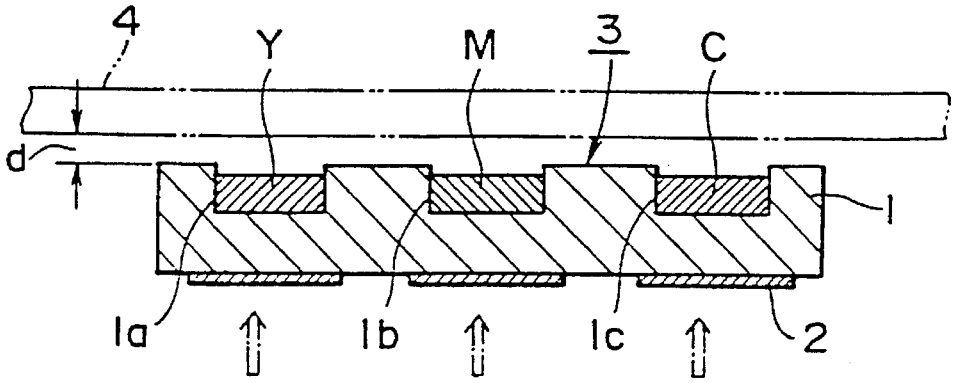

As shown in FIGS. 3(*a*) and 3(*b*), a tape-shaped printing medium 3 has a base tape 1 formed of polyester or the like, an yellow dye layer Y, a magenta dye layer M and a cyan dye layer C formed in stripes on one of the major surface of the base tape 1, and thin platinum black layers 2, which absorb a laser beam and generate heat, formed in stripes on the other major surface of the base tape 1 so as to correspond to the yellow dye layer Y, the magenta dye layer M and the cyan dye layer C, respectively, as best shown in FIG. 3(*b*)

Figure 1B:
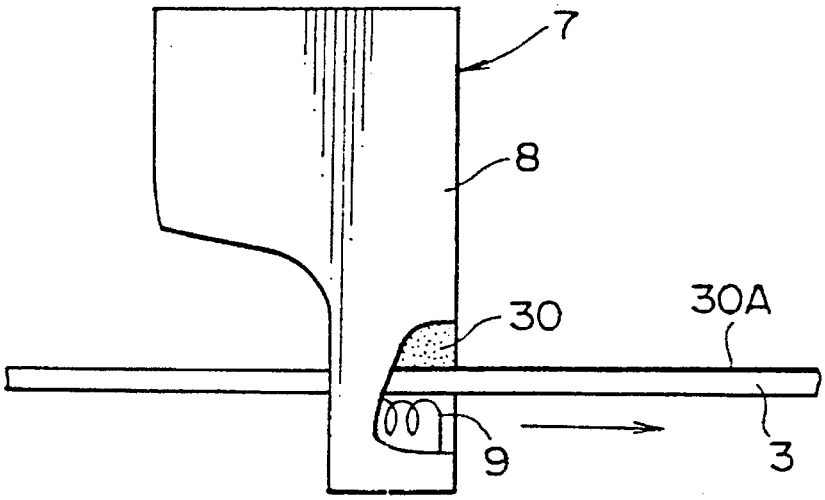

A printing method that uses the printing medium 3 shown in FIGS. 3(*a*) and 3(*b*) uses a printing apparatus as shown in FIG. 1(*a*). A recording sheet 4 is placed opposite to the printing medium 3 with a predetermined space d therebetween, and then the printing medium 3 is irradiated with a laser beam L indicated by the arrow A emitted by a laser 5 to heat the recording medium 3 for printing. Since the printing medium 3 and the recording sheet 4 are separated from each other by the space d, the reverse transfer of the dye does not occur and a picture can be printed in a high picture quality on the recording sheet 4. After one printing cycle has been completed, a roller 6 is rotated to turn the printing medium 3 and the dye layer of the printing medium 3 is replenished with the dye by a dye supply unit 7 at a position other than the position where the printing medium 3 is irradiated with the laser beam L to regenerate the dye layer of the printing medium 3. Thus, the printing medium 3 can be repeatedly used. As shown in FIG. 1(*b*), the dye supply unit 7 has a dye tank 8 for containing the powdered dye 30, and a heater 9 for heating the powdered dye 30 when the powdered dye 30 is supplied to the printing medium 3. When supplying the powdered dye 30, the printing medium 3 is passed through the dye supply unit 7, and at least a portion of the powdered dye 30 contained in the dye tank 8 and covering the surface of the printing medium 3 is fused by the heat generated by the heater 9 so that a dye film 30A is formed on the surface of the printing medium 3.

Figure 2:
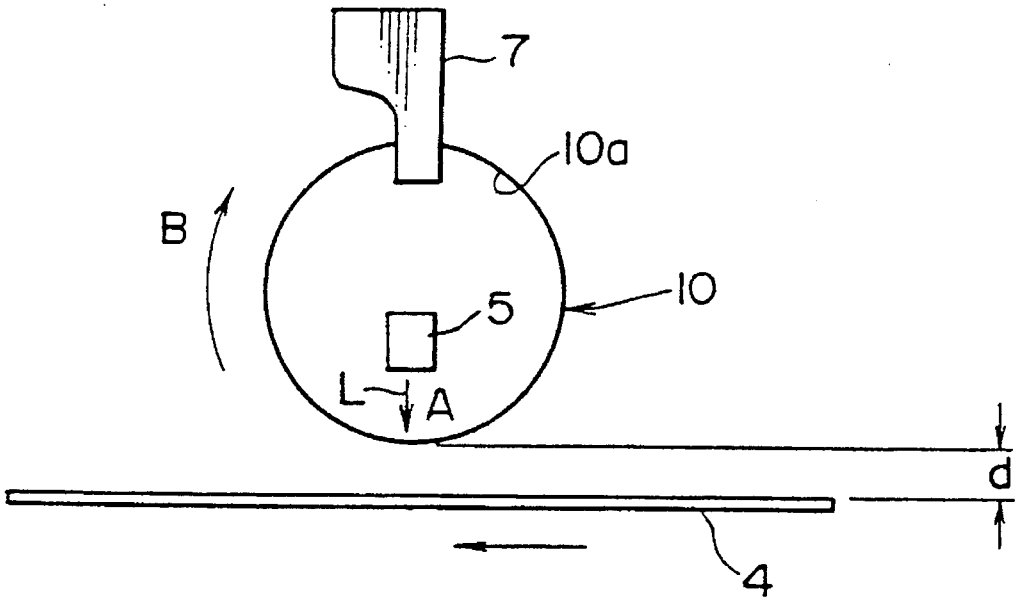
FIG. 2 is a schematic front view of another experimental printing apparatus in accordance with the present invention.

FIG. 2 shows cylindrical printing medium 10. The printing medium 10 is disposed opposite to a recording sheet 4 with a predetermined space d therebetween, and the printing medium 10 is irradiated with a laser beam emitted by a laser 5 as indicated by the arrow to heat the printing medium 10 for printing. Since the printing medium 10 and the recording sheet 4 are separated by the space d, the reverse transfer of the dye does not occur and a picture can be printed on the recording sheet 4 in a satisfactory picture quality. After one printing cycle has been completed, the printing medium 10 is rotated in the direction of the arrow B, and the printing medium 10 is replenished with the dye by a dye supply unit 7 disposed at a position other than the position where the printing medium 10 is irradiated with the laser beam to regenerate the dye layer of the printing medium 10. Thus, the printing medium 10 can be repeatedly used. The dye supply unit 7 may be the same as that shown in FIG. 1(*b*).

Figure 4:
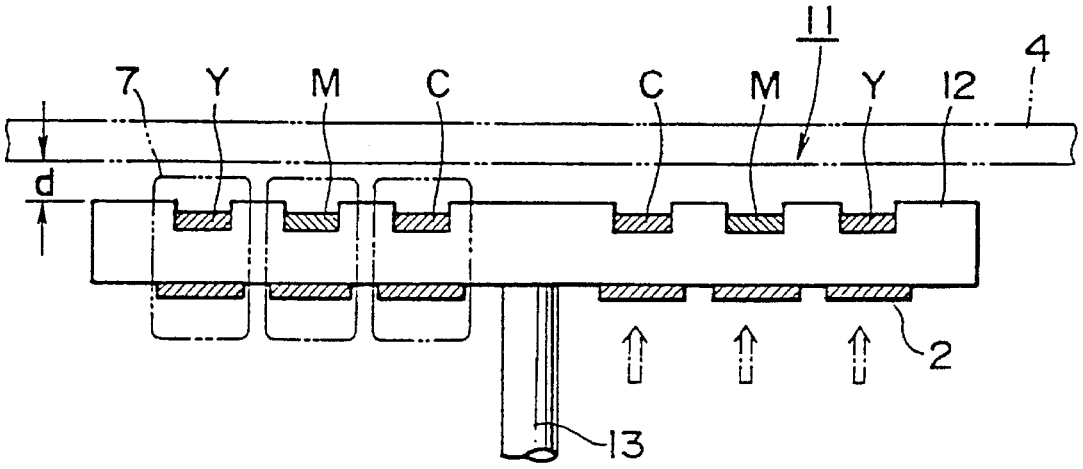
FIG. 4 is an enlarged sectional view of an experimental disk shaped printing medium.

FIG. 4 shows a disk-shaped printing medium 11. The printing medium 11 has a disk-shaped base sheet 12, a circular yellow dye layer Y, a circular magenta dye layer M and a circular cyan dye layer C, which are concentric with each other, formed on one of the major surfaces of the base sheet 12, and concentric circular platinum black thin layers 2 formed on the other major surface of the base sheet 12 so as to correspond to the yellow dye layer Y, the magenta dye layer M and the cyan dye layer C, respectively. When printing a picture on a recording sheet 4, the printing medium 11 is disposed opposite to the recording sheet 4 with a predetermined space d therebetween, and the printing medium 11 is irradiated with laser beams emitted by lasers to heat the printing medium 11 for printing. Since the printing medium 11 and the recording sheet 4 are separated from each other by the predetermined space d, the reverse transfer of the dyes will not occur and a picture can be printed on the recording sheet 4 in a satisfactory picture quality. After one printing cycle has been completed, the printing medium 11 is rotated and the yellow dye layer Y, the magenta dye layer M and the cyan dye layer C are replenished with the corresponding dyes by dye supply units 7 at positions other than the positions where the yellow dye layer Y, the magenta dye layer M and the cyan dye layer C are irradiated with the laser beams, respectively, to regenerate the yellow dye layer Y, the magenta dye layer M and the cyan dye layer C. Thus, the printing medium 11 can be repeatedly used. The dye supply units 7 may be the same as that shown in FIG. 1(*b*).

The foregoing printing method of the present invention can be carried out by using any suitable printing medium, such as the printing medium 3, 10 or 11. It is also possible to carry out the printing method of the present invention by using the following printing medium.

The printing medium is featured by a dye layer containing a dye and a surface active agent. The surface active agent contained in the dye layer suppresses the spread of the fused dye on a recording medium so that a picture can be clearly printed on the recording sheet. The surface active agent may be of any kind, provided that the surface active agent is capable of reducing the surface tension of the fused dye or the dependence of the surface of the dye on temperature. It is preferable that the surface active agent is stable at temperatures in the range of 100° to 200° C., has a low volatility and is noncombustible.

Possible surface active agents are, for example, anionic surface active agents including fatty acids respectively having carbon numbers in the range of six to twenty-four, alkali salts of those fatty acids, higher alcohol ester phosphate salts and higher alcohol sulfonates, cationic surface active agents including higher carboxyl amine salts, quaternary ammonium salts and alkyl pyridium salts, nonionic surface active agents including polyoxyethylene alkyl esters, polyoxyethylene alkyl esters and polyoxyethylene phenol ethers, and silicone surface active agents including dimethyl polysiloxanes and copolymers of dimethyl polysiloxanes and polyoxyethylene.

Above all, anionic surface active agents are preferable because the acid residues of anionic surface active agents have high affinity for the amine residues of the dyes. These surface active agents may be used individually or in combination. Although dependent on the types of the dye and the surface active agent, generally, the surface active agent content of the dye layer is in the range of 0.001 to 10% by weight. The dye of the printing medium may be a heat-diffusive dye, such as a sublimable dye. The dye layer of the printing medium may contain a binder and various additives. However, to enable the printing medium to function properly for repeated use, it is preferable that the dye layer of the printing medium does not contain any binder and contain the dye in a large amount of dye per unit area of the dye layer so that the dye can be quickly supplied when heated. There is no particular restriction on the morphology of the printing medium of the present invention, provided that the dye layer of the printing medium contains a dye and a surface active agent. For example, the printing medium may be an ink ribbon, similar to the conventional ink ribbon, having a base sheet and a dye layer formed on the base sheet or may be a printing chip having a base plate, such as a glass plate, and a dye layer formed on the portion of the surface of the base plate.

Although there is no particular restriction on the printing method that uses the printing medium, a transfer printing method that places a printing medium and a recording medium in contact with each other is not suitable for using the printing medium of the present invention because the dye of the dye layer not containing any binder of the printing medium of the present invention is fused for transfer. Therefore, the thermal sublimation transfer printing method of the present invention that holds the printing medium and the recording medium with a space of a given thickness therebetween is suitable for using the printing medium of the present invention.

Since the printing method of the present invention holds the printing medium and the recording medium with a space having a thickness in the range of 1 to 100 μm therebetween during printing, the heat supplied to the printing medium for thermal transfer is not diffused in the recording medium and unnecessary heating of the dye previously transferred from the printing medium to the recording medium can be avoided. Accordingly, reverse transfer of dyes, which is a significant problem in printing a color picture, can be prevented. Since portions of the dye layer of the printing medium can be concentratedly heated, a sharp picture can be printed.

Since the printing medium of the present invention has a dye layer containing a surface active agent, the surface tension of the fused dye or the temperature dependence of the surface tension of the fused dye can be reduced. Accordingly, when portions of the dye layer to be transferred to the recording medium are heated to fuse the dye in the heated portions of the dye layer, the dye in the heated portions of the dye layer will not be caused to spread by the nonheated portions of the dye layer. Consequently, the reduction of the dye density of the heated portions of the dye layer can be prevented. This effect is particularly conspicuous when the dye layer is a binderless dye layer.

In view of preventing the thermal deterioration of the heating medium, it is desirable that the dye, i.e., the printing material, for thermal sublimation transfer printing has a boiling point not higher than its decomposition point. It is desirable that the dye has a boiling point in the range of 50° to 600° C., more desirably in the range of 80° to 450° C., most desirably in the range of 250° to 450° C. When a dye having such a comparatively low boiling point is used, the heating medium need not be heated at an excessively high temperature and whereby the thermal deterioration of the heating medium can be prevented. Possible dyes are dyes having dicyanostyryl groups, quinophthalone dyes and anthraquinone dyes.

Dicyanostyryl Group

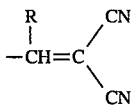

R: Hydrogen atom or a substituent, such as an alkyl group or a cyanogroup

Quinophthalone Dye

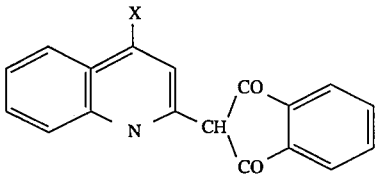

X: A halogen atom

The following dyes are exemplary possible dyes.

Yellow dyes:

HSY-2068 (Mitsubishi Kasei)

Solvent-Yellow-56

Magenta dyes

HSR-2109 (Mitsubishi Kasei)

HSR-2031 (Mitsubishi Kasei)

HSR-2063 (Mitsubishi Kasei)

Solvent-Red-19

Cyan dyes

HSB-2000-2 (Mitsubishi Kasei)

Solvent-Blue-35

Results of experiments obtained through experimental printing using the printing media shown in FIGS. 3(*a*), 3(*b*) and 4 and the printing apparatus shown in FIGS. 1(*a*), 1(*b*) and 2 will be described.

EXPERIMENT 1

An ink sheet similar to a printing medium shown in FIG. 3(*b*) was fabricated by forming three parallel grooves 1*a*, 1*b* and 1*c* having a depth of 5 μm and a width of 100 μm in one major surface of a titanium film 1 having a thickness of 10 μm, forming a yellow dye layer containing an yellow dye Y (ESC151®, Sumitomo Kagaku), a magenta dye layer containing a magenta dye M (ESC451®, Sumitomo Kagaku) and a cyan dye layer containing a cyan dye C (Foron Blue®, Sando) respectively in the three parallel grooves 1*a*, 1*b* and 1*c*, and forming thin platinum black layers 2 having a width of 200 μm and a thickness of 5 μm on the other major surface of the titanium film 1 in areas respectively corresponding to the dye layers.

Linear color pictures were formed on a recording sheet 4 (VPM-30STA®, Sony Corp.) by using the ink sheet 3 in a manner as shown in FIG. 1(*a*), and the dye layers were replenished continuously with the corresponding dyes by dye supply units 7 as shown in FIG. 1(*b*). The ink sheet 3 was disposed with the surface provided with the dye layers facing the dye-accepting layer of the recording sheet 4 with a space d having a thickness of 10 μm between the surface provided with the dye layers and the dye-accepting layer, the ink sheet 3 was moved at a speed of 4 cm/sec, the recording sheet 4 was fed at a speed of 2 cm/sec, and the ink sheet was irradiated with laser beams having a wavelength of 780 nm emitted by semiconductor lasers having an output capacity of 30 mW for continuous printing. During the printing process, powdered dyes 30 contained in the dye supply units were heated with heaters 9 to fuse the dyes 30 and the fused dyes 30A were supplied to the corresponding dye layers of the ink sheet 3.

Linear color pictures having an optical density of 2.3 and a width of 85 μm were formed by the printing process, in which the reverse transfer of the dyes did not occur. The dye layers of the ink sheet 3 were replenished with the corresponding dyes and the printing process was carried out continuously without deteriorating picture quality.

EXPERIMENT 2

An ink cylinder 10, i.e., a printing medium, formed by wrapping the ink sheet 3 employed in the experiment 1 around a polyethylene terephthalate cylinder 10*a* having a wall thickness of 100 μm was used. Linear color pictures were formed on a recording sheet 4 (VPM-30STA®, Sony Corp.) by using the ink cylinder 10 in a manner as shown in FIG. 2, and the dye layers were replenished continuously with the corresponding dyes by dye supply units 7 as shown in FIG. 1(*b*). The ink cylinder 10 was disposed with the surface provided with the dye layers facing the dye-accepting layer of the recording sheet 4 with a space d having a thickness of 10 μm, the ink cylinder 10 was rotated at one turn per second, the recording sheet 4 was fed at a speed of 2 cm/sec, and the ink cylinder 10 was irradiated with laser beams having a wavelength of 780 nm emitted by semiconductor lasers having an output capacity of 30 mW for continuous printing. During the printing process, the powdered dyes 30 contained in the dye supply units 7 were heated with heaters 9 to fuse the dyes and the fused dyes 30A were supplied to the corresponding dye layers of the ink sheet 3.

Linear color pictures having an optical density of 2.3 and a width of 85 μm were printed by the printing process, in which the reverse transfer of the dyes did not occur. The dye layers of the ink sheet 3 were replenished with the corresponding dyes and the printing process was carried out continuously without deteriorating picture quality.

EXPERIMENT 3

An ink disk, i.e., a printing medium, was fabricated by forming a disk by mounting a circular titanium sheet 12 having a diameter of 20 mm and a thickness of 10 μm on a glass disk having a diameter of 20 mm and a thickness of 100 μm, forming three concentric grooves 12*a*, 12*b* and 12*c* having a depth of 5 μm and a width of 100 μm in one of the major surfaces, forming a yellow dye layer containing a yellow dye Y (ESC151®, Sumitomo Kagaku), a magenta dye layer containing a magenta dye M (ESC451®, Sumitomo Kagaku) and a cyan dye layer containing a cyan dye C (Foron Blue®, Sando) respectively in the three concentric grooves 12*a*, 12*b* and 12*c*, and forming concentric thin platinum black layers 2 having a width of 200 μm and a thickness of 5 μm on the back surface of the titanium sheet 12 in areas corresponding to the dye layers. Linear color pictures were printed on a recording sheet 4 (VPM-30STA®, Sony Corp.) by using the ink disk. During the printing process, the dye layers of the ink disk were replenished continuously with the corresponding dyes by dye supply units 7, indicated by alternate long and two short dashes lines, as shown in FIG. 1(*b*). The ink disk was disposed with its dye layers facing the dye-accepting layer of the recording sheet 4 with a space having a thickness of 10 μm, the ink disk was turned at one turn per second, the recording sheet 4 was fed at a speed of 2 cm/sec, the ink disk was irradiated with laser beams having a wavelength of 780 nm emitted by semiconductor lasers having an output capacity of 30 mW for continuous printing. During the printing process, the dyes 30 contained in the dye supply units 7 were heated by heaters 9 to fuse the dyes 30 and the fused dyes 30A were supplied to the dye layers of the ink disk.

Linear color pictures having an optical density of 2.2 and a width of 85 μm were formed by the printing process, in which the reverse transfer of the dyes did not occur. The dye layers of the ink disk were replenished with the corresponding dyes and the printing process was carried out continuously without deteriorating picture quality.

COMPARATIVE EXPERIMENT 1

A printing process for the comparative experiment 1 was the same as that for the experiment 1, except that an ink sheet provided with dye layers having a thickness of 10 μm was employed and the ink sheet and the recording sheet were kept in contact with each other for the printing process for the comparative experiment 1. Reverse transfer of the dyes occurred and unclear linear color pictures were formed.

The following experiments were conducted to verify the effect of the addition of a surface active agent to the ink layer.

EXPERIMENT 4

An ink sheet was fabricated by preparing a dye solution by dissolving a magenta dye (HSR 2030®, Mitsubishi Kasei) in a concentration of 10 g/l and stearyl, i.e., a surface active agent, in a concentration of 10 mg/l in aceton, coating the surface of an aramide film provided with a Ni/Co alloy film, i.e., light-to-heat conversion layer, having a thickness of 0.2 μm formed by evaporation with the dye solution in a thickness of about 1 μm by means of a wire bar, and evaporating aceton from the dye solution coating the surface of the aramide film in a thickness of about 4 μm. A linear picture was printed on a recording sheet (VPM-30STA® Sony Corp.) by an experimental printing apparatus shown in FIG. 6.

Figure 6:
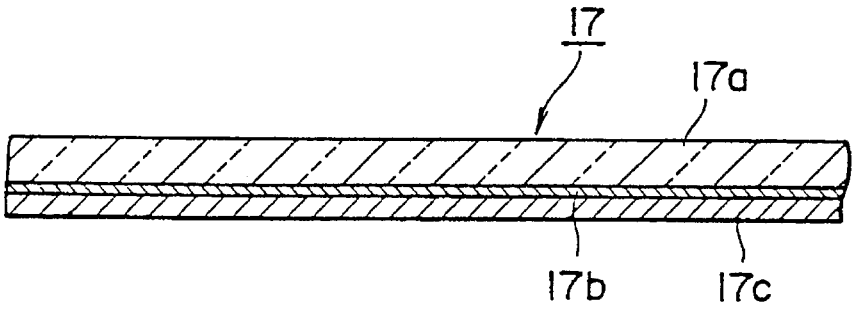
FIG. 6 is an enlarged sectional view of an ink sheet to be used on the printing apparatus of FIG. 5.

FIG. 6 is an enlarged sectional view of the ink sheet. The ink sheet 17 is fabricated by sequentially forming a 0.2 μm thick Ni-Co alloy film 17*b* by evaporation and a 1 μm thick magenta dye layer 17*c* on a 4 μm thick aramide film 17*a*.

Figure 5:
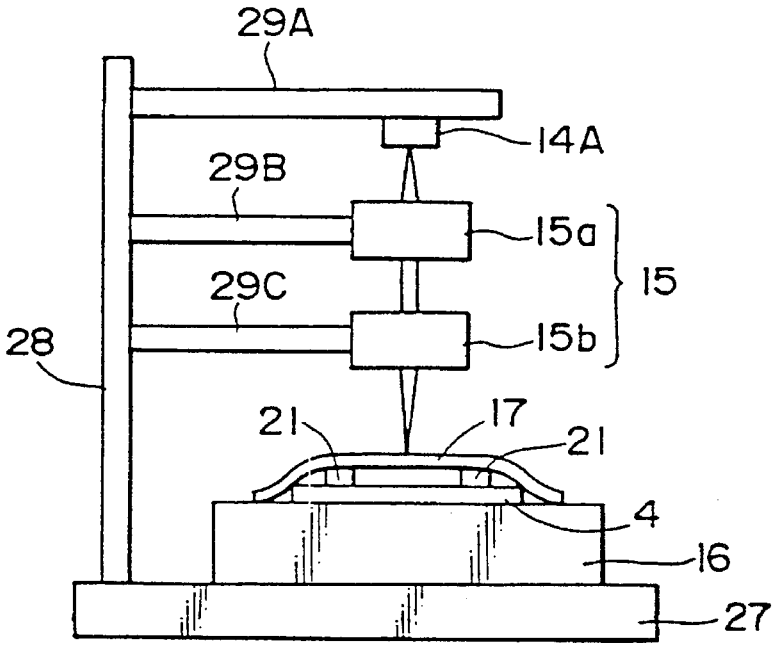
FIG. 5 is a third experimental printing apparatus in accordance with the present invention.

FIG. 5 is a schematic front view of an experimental printing apparatus. A standard 28 is set upright on a base plate 27, brackets 29A, 29B and 29C are fixed to the standard 28. Lenses 15*a* and 15*b*, and a semiconductor laser chip (SV-203®, Sony Corp.) 14A having an output capacity of 10 mW are supported respectively on the brackets 29C, 29B and 29A with their optical axes in alignment. The lenses 15*a* and 15*b* constitute a focusing lens system 15. A recording sheet 4 is placed on an XY stage 16 mounted on the base plate 27, and an ink sheet is superposed on the recording sheet 4 for thermal printing. In this experiment, the ink sheet 17 is superposed on the recording sheet 4 with a spacer 21 therebetween. A laser beam was focused on the recording sheet 4 in a spot of 20 μm×30 μm while the recording sheet 4 was fed at a liner speed of 1 cm/sec. A line having an optical density of 2.4 and a width of about 110 μm was printed.

COMPARATIVE EXPERIMENT 2

An ink sheet used in the comparative experiment 2 was the same as that used in the experiment 4, except that the ink sheet used in the comparative experiment 2 is provided with an ink layer not containing any surface active agent. The experimental printing apparatus shown in FIG. 5 was used. A line having a small optical density of 1.2 and a width of about 30 μm was printed. The amount of the dye transferred from the ink sheet to the recording sheet 4 was about ⅓ of the amount of the dye transferred from the ink sheet to the recording sheet in the experiment 4.

EXPERIMENT 5

Figure 7:
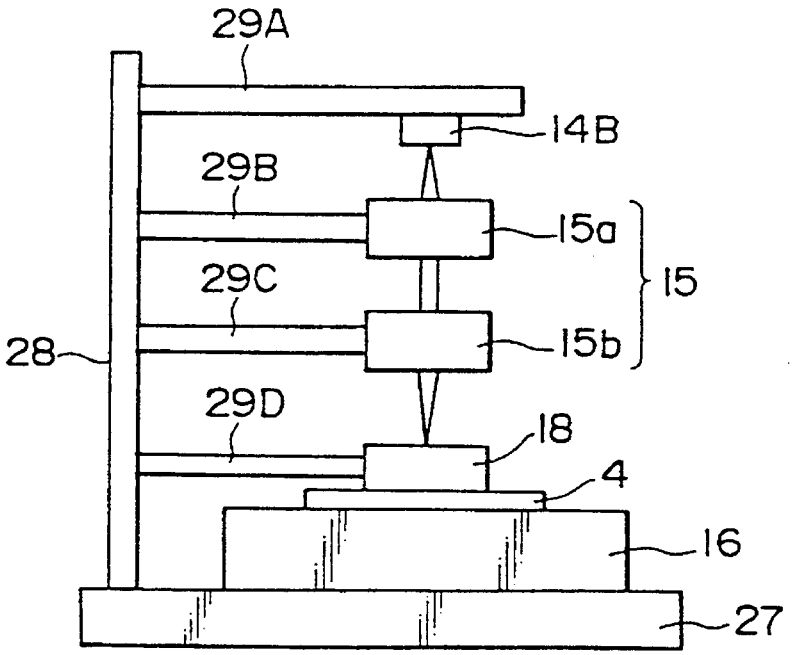
FIG. 7 is a schematic front view of a fourth experimental printing apparatus in accordance with the present invention.

In the experiment 5, neither an ink sheet nor an ink film was used, and a printing chip, i.e., a heating medium, carrying a mixture of a dye and a surface active agent was used. FIG. 7 is a schematic front view of an experimental printing apparatus employed in the experiment 5.

The printing apparatus shown in FIG. 7 is similar in construction to that shown in FIG. 5, except that the former has a bracket 29D fixed to a standard 28, and a printing chip 18 held on the bracket 29D in addition to the components of the latter. As shown in FIG. 7, a standard 28 is set upright on a base plate 27, brackets 29A, 29B, 29C and 29D are fixed to the standard 28, the printing chip 18, lenses 15*a* and 15*b*, and a semiconductor laser chip (SLD-203®, Sony Corp.) 14B are held respectively on the brackets 29D, 29C, 29B and 29A with their optical axes in alignment. The lenses 15*a* and 15*b* constitute a focusing lens system 15. An XY stage 16 is fixedly mounted on the base plate 27, and a recording sheet 4 is placed on the XY stage 16.

Figure 8A:
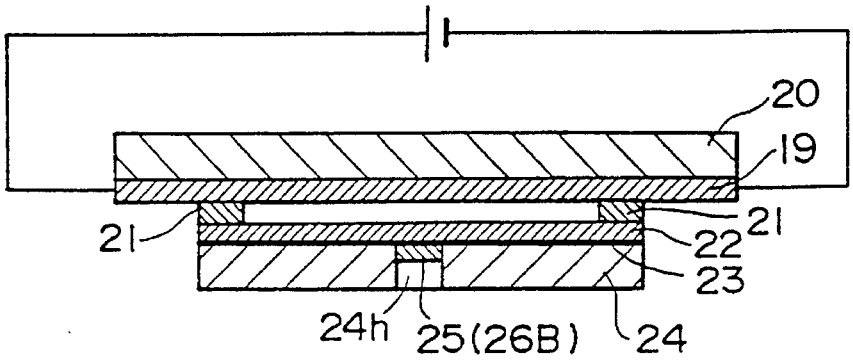
FIG. 8(*a*) is an enlarged sectional view of a printing chip employed in the printing apparatus of FIG. 7.
Figure 8B:
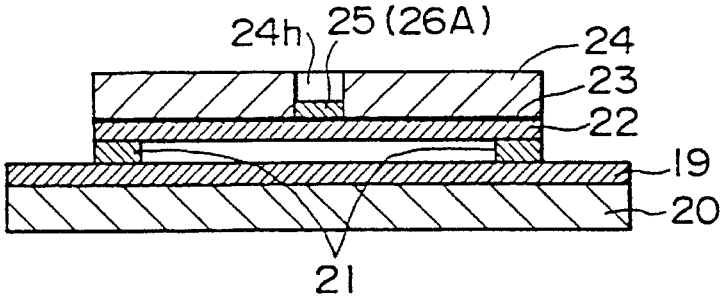
Figure 9:
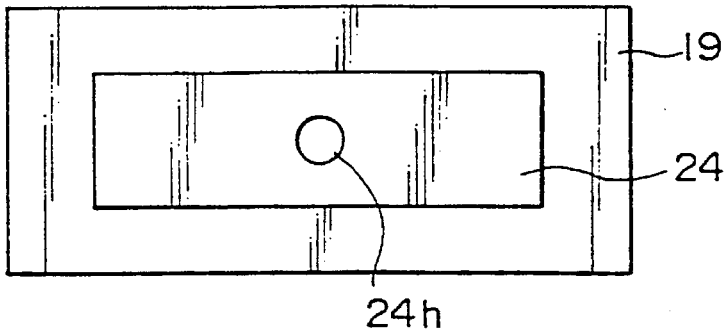
FIG. 9 is an enlarged bottom view of the printing chip of FIG. 8.

FIGS. 8(*a*) and 9 are an enlarged sectional view and an enlarged bottom view, respectively, of the printing chip 18. The printing chip 18 comprises a glass plate 20, an ITO film (indium tin oxide film) 19 as a resistance heating element formed by evaporation on the lower surface of the glass plate 20, heat insulating spacers 21 put in contact with the ITO film 19, a 4 μm thick polyimide film 22 coated with an evaporated 0.2 μm thick Ni/Co alloy film 23 as a light-to-heat conversion element and extended on the spacers 21, and a 10 μm thick stainless steel sheet 24 attached to the polyimide film 22 and provided with a dye pit 24*h* having a diameter of about 1 mm. During a printing process, the stainless steel sheet 24 is in contact with the recording sheet 4 (STA-30®, Sony Corp.).

In this experiment, the printing chip 18 was removed from the printing apparatus, the printing chip 18 was held with the dye pit 24 facing up in a state shown in 8(*b*), a mixture 25 of 1 g of a magenta dye (HSR2031®, Mitsubishi Kasei) and 1 mg of a surface active agent was put in the dye pit 24 so as to fill about ⅓ of the depth thereof, energy was supplied to the resistance heating element 19 to fuse the mixture 25, and then the printing chip 18 was set in place on the bracket 29D. The printing chip 18 was irradiated with a laser beam emitted by the semiconductor laser chip 14B while the recording sheet 4 was fed at a linear speed of 1 cm/sec. A line having an optical density of 2.4 and a width of about 110 μm was printed.

COMPARATIVE EXPERIMENT 3

The comparative experiment 3 is the same as the experiment 5, except that the former does not use any surface active agent. The printing chip 18 and the printing apparatus shown in FIG. 7 were used. Any picture could not be printed at all.

Results of experiments conducted to examine the dependence of results of printing on the boiling point of the dye will be described hereinafter.

EXPERIMENT 6

Figure 10:
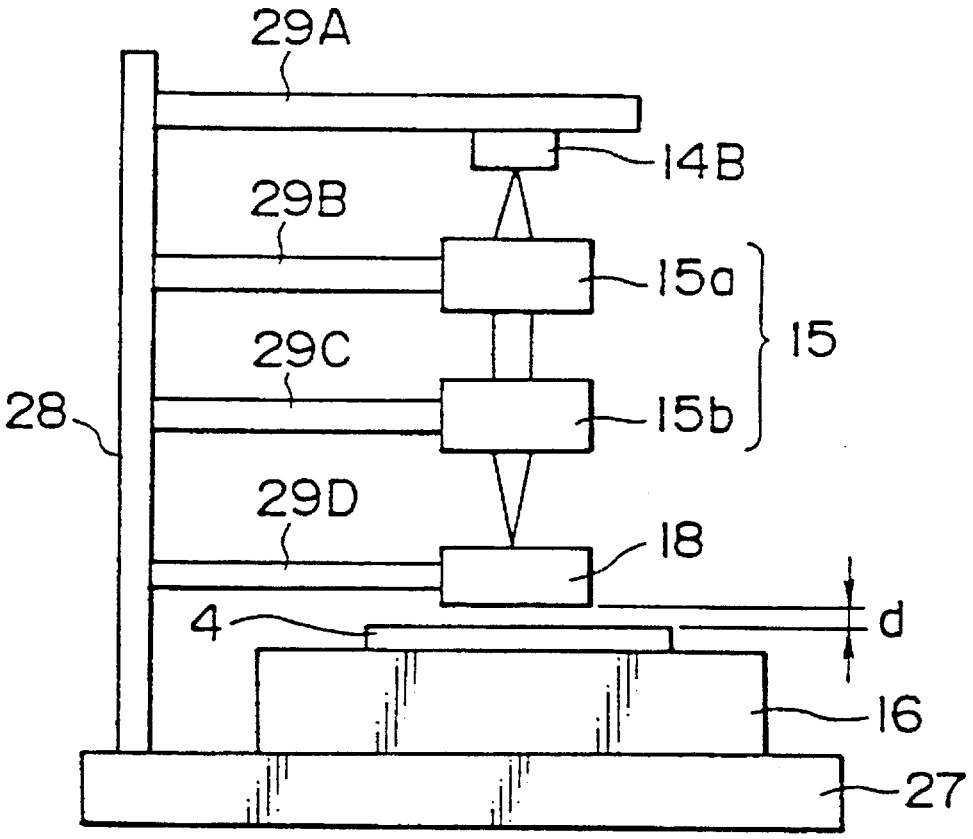
FIG. 10 is a schematic front view of a fifth experimental printing apparatus in accordance with the present invention.

FIG. 10 is a schematic front view of an experimental printing apparatus employed in the experiment 6. The printing apparatus shown in FIG. 10 is the same in construction as the printing apparatus shown in FIG. 7, except that the former has a printing chip 18 disposed opposite to a recording sheet 4 with a space d therebetween.

A powdered yellow dye 26A (HSY-2068®, Mitsubishi Kasei) having a melting point 103° C. and boiling point of 378° C. was put in the dye pit **24*h* formed in the stainless steel sheet 24 (FIG. 8**(*a*)), and then energy was supplied to the resistance heating element 19 to heat the yellow dye at 120° C. to fuse the same. The depth of the fused dye 26B in the dye pit **24*h* was 4 μm. The fused dye 26B on the Ni/Co alloy film 23 was irradiated continuously for sixty minutes with a laser beam emitted by the semiconductor laser 14B having an output capacity of 30 mW while the recording sheet 4** was fed at a speed of 10 cm/sec. The laser beam was focused in a spot of 20 μm×30 μm.

A line having an optical density of 1.8 and a width of about 85 μm was printed on the recording sheet 4. There was no thermal deterioration of the light-to-heat conversion layer consisting of the polyimide film 22 and the Ni/Co alloy film 23, and portions of the printing chip 18 around the light-to-heat conversion layer.

EXPERIMENT 7

A printing process similar to that carried out in the experiment 6 was carried out. Eyes shown in the following table were Used. The chemical constitution of the representative one of the dyes of each color is as follows.

Solvent Yellow-56 (Yellow dye)

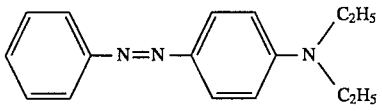

-continued

Solvent Red-19 (Magenta dye)

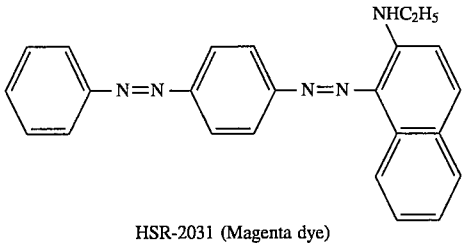

HSR-2031 (Magenta dye)

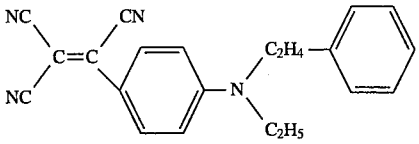

Solvent Blue-35 (Magenta dye)

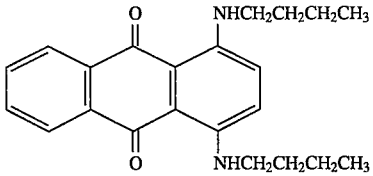

The dyes shown in the table, similarly to the dye used in the experiment 6, were heated to temperatures above the corresponding melting points for the experimental printing. All the lines formed by printing the dyes had optical densities not lower than 1.8. There was no thermal deterioration of the light-to-heat conversion layer and portions of the printing chip around the light-to-heat conversion chip.

TABLE

| Dyes | m.p.(°C.) | b.p.(°C.) |
|---|---|---|
| Solvent Yellow-56(Y) | 96 | 336 |
| Solvent Red-19 (M) | 130 | 323 |
| HSR-2109 (Mitsubishi Kasei) (M) | 65 | 368 |
| HSR-2031 (Mitsubishi Kasei) (M) | 123 | 427 |
| HSR-2063 (Mitsubishi Kasei) (M) | 186 | 398 |
| Solvent Blue-35 (C) | 121 | 398 |
| HSB-2000-2 (Mitsubishi Kasei) (C) | 157 | 358 |

Note:
(Y): Yellow dye, (M): Magenta dye, (C): Cyan dye

COMPARATIVE EXPERIMENT 4

A dye (MS Blue®, Mitsui Toatsu) having a melting point of 117° C., a decomposition point of 222° C. and a boiling point higher than the decomposition point was used. A printing process exactly the same as those carried out in the experiments 6 and 7 was carried out. The light-to-heat conversion layer was perforated fifteen minutes after the start of irradiation with the laser beam, which made the transfer of the dye impossible.

It is known from the results of the comparative experiment 4 and the experiments 6 and 7 that pictures can be satisfactorily printed when dyes having the boiling points not higher than their decomposition point are used.

Dyes having boiling points not higher than their decomposition points other than those shown in the experiments 6 and 7 are as follows.

Yellow: ESC-155 (Sumitomo Kagaku)

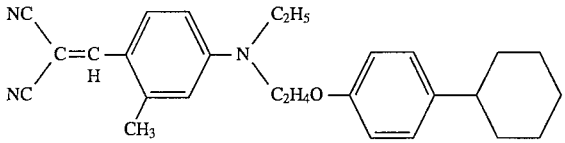

Cyan: ESC-655 (Sumitomo Kagaku)

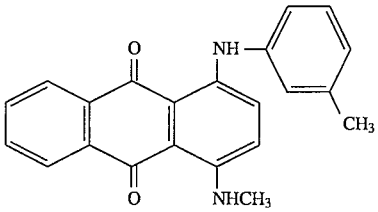

Yellow: Disperse Yellow-64

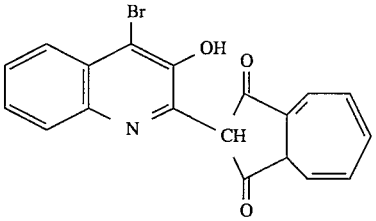

Yellow: Disperse Yellow-134, -143, -160

(Quinophthalone dyes)

Magenta: Kayaset Red-114 (Solvent Red-114)

(Nippon Kayaku)

Magenta: Kayaset Red-G (Solvent Red-111)

(Nippon Kayaku)

Yellow: Kayaset Orange-G (Solvent Orange-80)

(Nippon Kayaku)

Cyan: Kayaset Blue-FR (Solvent Blue-105)

(Nippon Kayaku)

Yellow: Kayaset Flavine FG (Solvent Yellow-116)

(Nippon Kayaku)

Magenta: Sumiplast Red-FG (Solvent Red-146)

(Anthraquionne dye) (Sumitomo Kagaku)

Cyan: Sumiplast Blue-OA (Solvent Blue-36)

(Anthraquinone dye) (Sumitomo Kagaku)

Magenta: Sumiplast Red-3B (Solvent Red-145)

(Sumitomo Kagaku)

Magenta: Sumiplast Violet-RP (Solvent Violet-28)

-continued (Sumitomo Kagaku)

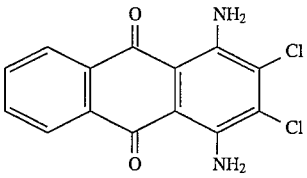

Magenta: Disperse Red-15

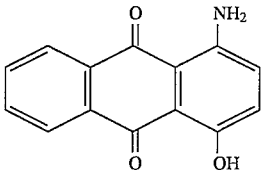

Cyan: Solvent Blue-59

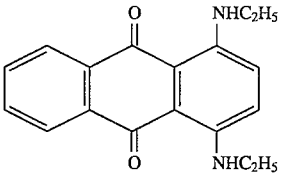

Figure 14:
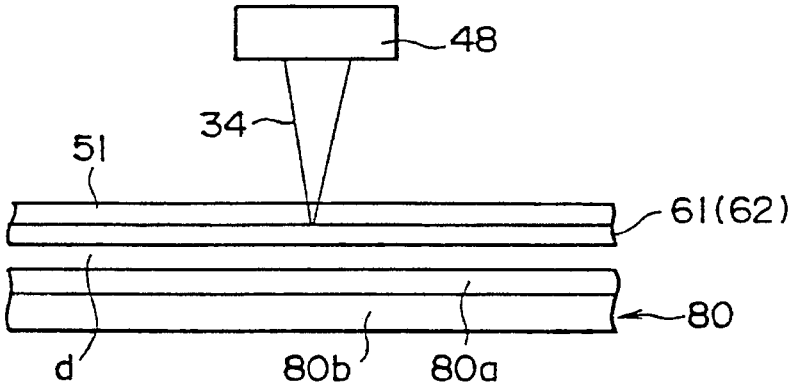
FIG. 14 is a schematic sectional view of the print head of the printing apparatus shown in FIG. 11.
Figure 15A:
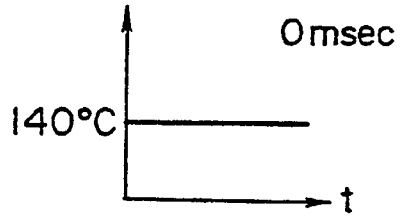
FIGS. 15(*a*), 15(*b*), 15(*c*) and 15(*d*) are views of assistance in explaining the variation of the temperature of a heat-resistant transparent layer with the duration of irradiation of the heat-resistant transparent layer with a laser beam, and FIGS. 15(*e*), 15(*f*), 15(*g*) and 15(*h*) illustrate a mode of transfer of a dye from a print head to a recording medium.
Figure 15B:
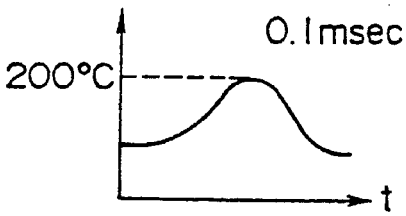
Figure 15C:
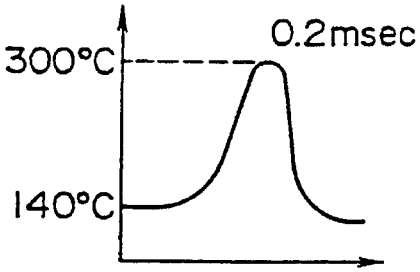
Figure 15D:
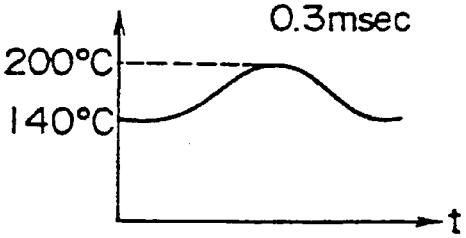
Figure 15E:
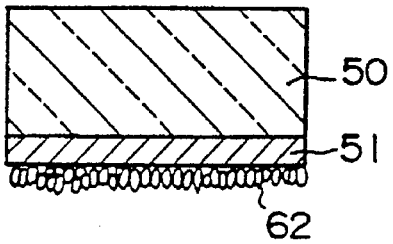
Figure 15F:
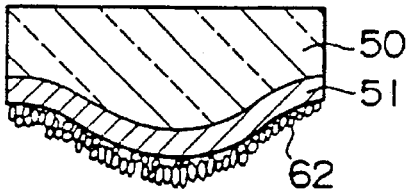
Figure 15G:
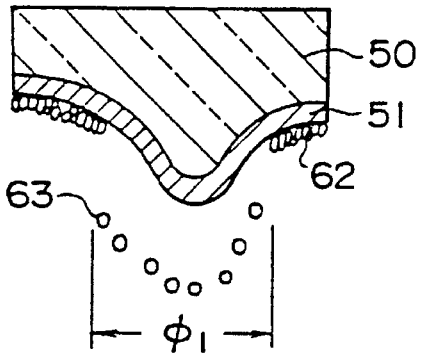
Figure 15H:
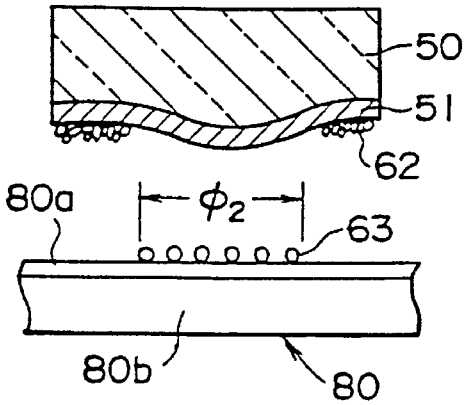

A printing apparatus in a preferred embodiment according to the present invention will be described hereinafter. The construction of the printing unit of the printing apparatus will be briefly described with reference to FIG. 14.

A semiconductor laser chip 48 is disposed above a light-to-heat conversion layer 51, and a recording sheet 80 is placed under the light-to-heat conversion layer 51. The recording sheet 80 has a base sheet 80*b*, and a dye-accepting layer 80*a* formed on the upper surface of the base sheet 80*b*. A space d having a thickness in the range of 10 to 100 μm is secured between the light-to-heat conversion layer 51 and the dye-accepting layer 80*a*. In this embodiment, the thickness of the space d is 60 μm. A dye layer 61 or a fused dye layer 62 is formed on the lower surface of the light-to-heat conversion layer 51. The light energy of a laser beam L emitted by the semiconductor laser chip 48 is converted into thermal energy by the light-to-heat conversion layer 51 to gasify or sublimate the dye of the dye layer 61 or the fused dye layer 62. The gasified or sublimated dye is transferred through the space d to the dye-accepting layer 80*a* and is fixed to the dye-accepting layer 80*a* for printing.

Figure 11:
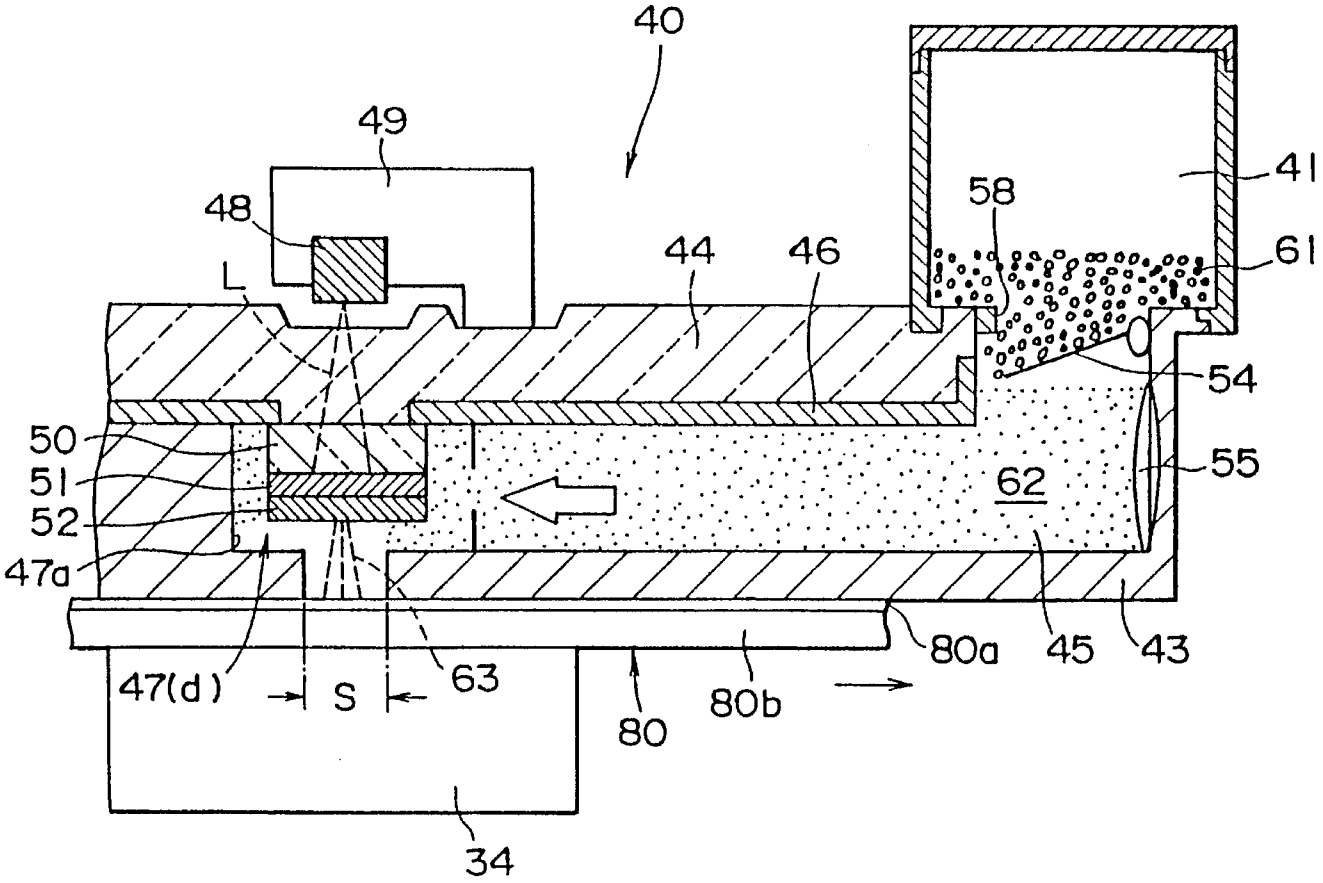
FIG. 11 is a sectional view of a print head included in a printing apparatus in a preferred embodiment according to the present invention.
Figure 12:
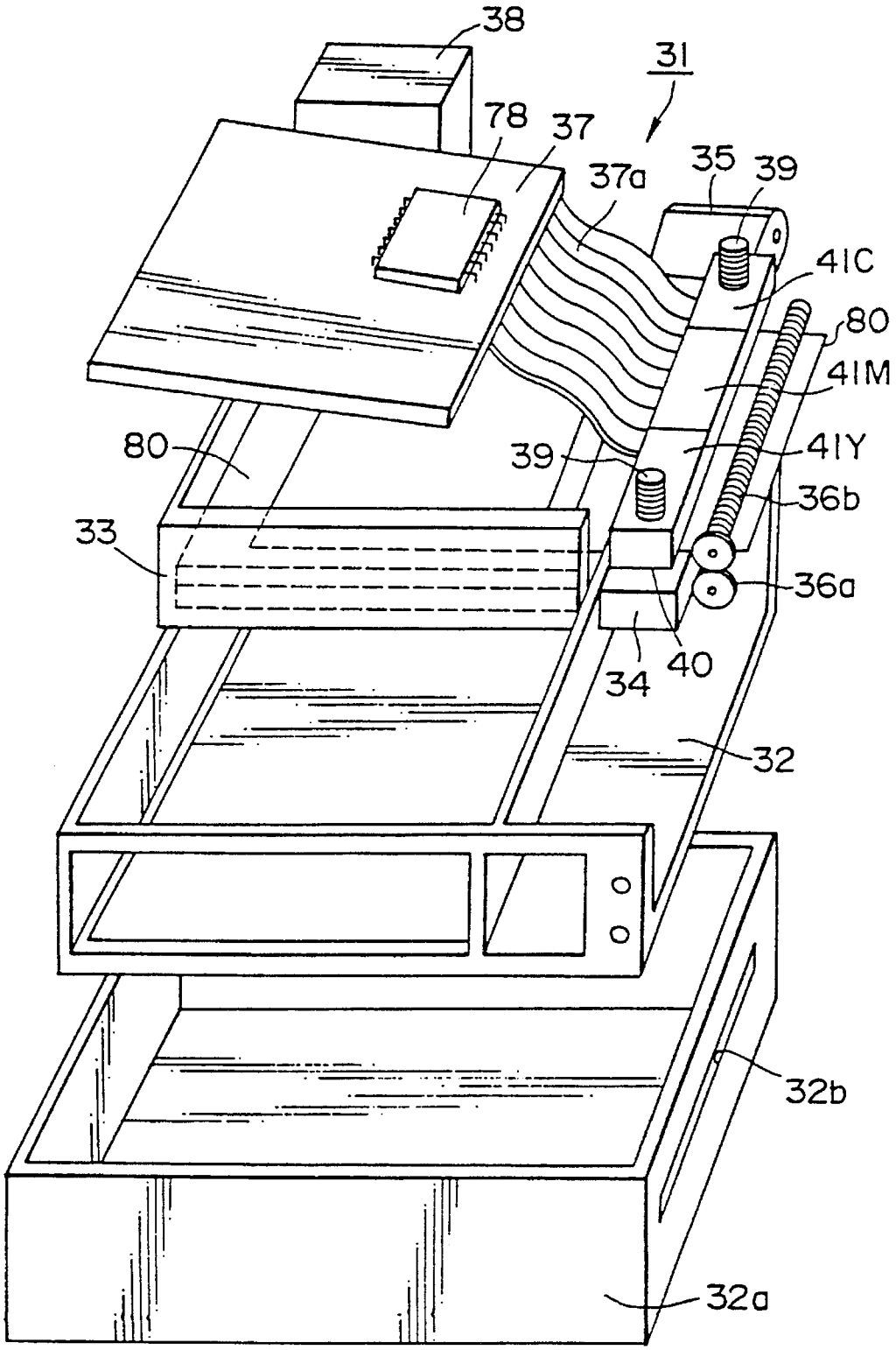
FIG. 12 is an exploded perspective view of the printing apparatus shown in FIG. 11.
Figure 13:
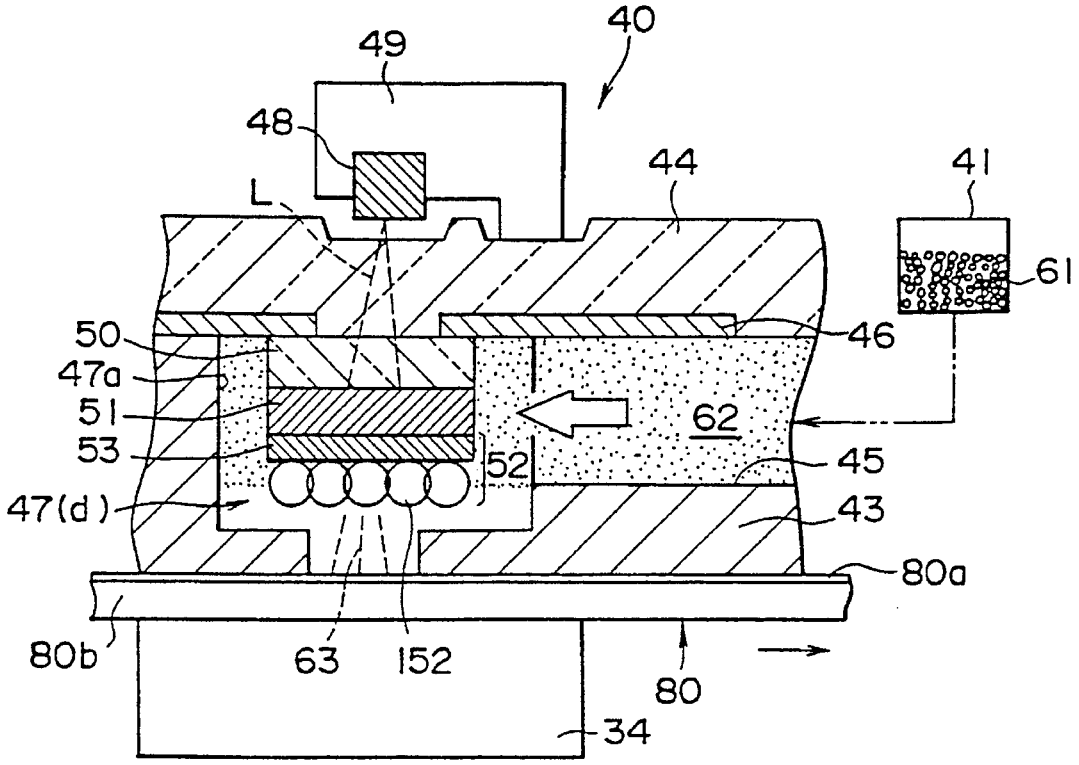
FIG. 13 is a fragmentary sectional view of the print head, for assistance in explaining a printing mechanism.

FIG. 11 is a sectional view of the printing unit, FIG. 12 is an exploded perspective view of the printing apparatus and FIG. 13 is a schematic sectional view of the printing unit for assistance in explaining the printing mechanism of the printing apparatus. First the printing mechanism will be described with reference to FIGS. 12 and 13. Referring to FIGS. 12 and 13, a laser sublimation transfer color video printer (laser sublimation transfer printer) 31 has a chassis 32 covered with a housing 32*a*. A sheet cassette 33 containing recording sheets 80 and a flat platen 34 are placed on the chassis 32.

A sheet feed roller 36*a*, which is driven by a motor 35 or the like, is disposed near a sheet outlet 32*b* formed in the housing 32*a*, and a recording sheet 80 is pressed lightly against the sheet feed roller 36*a* by a pressure roller 36*b*. A printed-circuit board 37 having a head driving circuit and provided with a driving IC 78, and a dc power supply 38 are disposed above the sheet cassette 33 within the housing 32*a*. A print head supported in the flat platen 34 is connected to the printed-circuit board 37 by a flexible harness 37*a*.

The print head 40 comprises powdered-dye tanks 41Y, 41M and 41C (which will be inclusively indicated by a reference numeral "41") respectively containing a powdered yellow (Y) sublimable dye 61Y, a powdered magenta (M) sublimable dye 61M and a powdered cyan (C) sublimable dye 61C (which will be inclusively indicated by a reference numeral "61"); liquid-dye tanks 45 each having a protective plate 43 formed of a high-strength abrasion-resistant material, a base plate 44 formed of glass or a transparent ceramic material and joined to the protective plate 43 so as to form a narrow space for containing a liquid dye, and a heater 46 having an electric resistance element and attached to the base plate 44 to heat and fuse the powdered sublimable dye 61 contained in the corresponding powdered-dye tank 41; gasifying units 47 each for gasifying the liquid sublimable dye (liquid dispersed dye) 62 introduced therein from the corresponding liquid-dye tank 45; and semiconductor laser chips 48 (laser light sources) each attached to a support plate 49 fixed to the base plate 44 to irradiate the gasifying unit with a laser beam L.

Each gasifying unit 47 has a gasifying pit 47*a*. Disposed within the gasifying pit 47*a* are a transparent heat insulating layer 50 attached to the lower surface of the base plate 44, a light-to-heat conversion layer 51, which absorbs a laser beam L and converts the light energy of the laser beam L into thermal energy, formed on the lower surface of the transparent heat insulating layer 50, an adhesive layer 53 formed on the lower surface of the light-to-heat conversion layer 51, and a dye holding layer 152 for holding the liquid sublimable dye 62, formed by adhesively attaching glass beads to the adhesive layer 53. The transparent heat insulating layer 50 is formed of a transparent PET resin. The light-to-heat conversion layer 51 is formed by spreading a mixture of a binder and carbon particles over the lower surface of the transparent heat insulating layer 50. The diameters of the glass beads forming the dye holding layer 152 are in the range of 5 to 10 μm. The heater 46 heats and liquidize the powdered sublimable dye 61 so that the liquid sublimable dye 62 will diffuse into the dye holding layer 152.

The recording sheets 80 contained in the sheet cassette 33 put on the laser sublimation transfer color video printer 31 are fed one at a time through the space between the flat platen 34 and the print head 40 to the feed roller 36*a*. The print head 40 is pressed lightly against the flat platen 34 at a small pressure of about 50 g with a pair of weak springs 39 to press the recording sheet 80 against the flat platen 34. The semiconductor laser chips 48 are arranged on the print head 40 in three rows respectively for yellow pixels, magenta pixels and cyan pixels. The number of the semiconductor laser chips 48 in each row is equal to that of pixels on each printing line. The powdered dyes are fed from the powdered-dye tanks 41 (41Y, 41M, 41C) into the corresponding liquid-dye tanks 45, the powdered dyes are heated and liquidized, and then the liquidized dyes are supplied to the corresponding gasifying units 47.

The powdered sublimable dye 61 fed from each powdered-dye tank 41 is heated to its melting point by the heater 46 to fuse (liquidize) the powdered sublimable dye, the liquid sublimable dye 62 is supplied by the capillary effect of the liquid-dye tank 45 to the gasifying unit 47, and a fixed amount of the liquid sublimable dye 62 is held by the dye holding layer 152 formed in the gasifying pit 47*a* of the gasifying unit 47. In this state, when the recording sheet 80 is held between the feed roller 36*a* and the pressure roller 36*b*, an image signal representing dots of one of the three colors on one printing line is supplied to the printing head 40, and then the semiconductor laser chips 48 emits laser beams L according to the image signal. The laser beams L are converted into heat by the light-to-heat conversion layers 51, respectively. Consequently, the yellow, magenta and cyan liquid sublimable dyes 62 held by the dye holding layers 152 are gasified sequentially in order of the yellow liquid sublimable dye, the magenta liquid sublimable dye and the cyan liquid sublimable dye, and the yellow, magenta and cyan gasified dyes 63 are transferred sequentially in that order to the dye-accepting layer 80*a* of the recording sheet 80 held between the flat platen 34 and the protective plates 43 to print a color picture.

FIG. 11 shows a print head 40 employed in a laser sublimation transfer color video printer 31. The print head 40 comprises powdered-dye tanks 41Y, 41M and 41C (which will be inclusively indicated by a reference numeral "41") respectively containing a powdered yellow (Y) sublimable dye 61Y, a powdered magenta (M) sublimable dye 61M and a powdered cyan (C) sublimable dye 61C (which will be inclusively indicated by a reference numeral "61"); liquid-dye tanks 45 each having a protective plate 43 formed of a high-strength abrasion-resistant material, a base plate 44 formed of glass or a transparent ceramic material and joined to the protective plate 43 so as to form a narrow space for containing a liquid dye, and a heater 46 having an electric resistance element and attached to the base plate 44 to heat and fuse the powdered sublimable dye 61 contained in the corresponding powdered-dye tank 41; gasifying units 47 each for gasifying the liquid sublimable dye (liquid dispersed dye) 62 introduced therein from the corresponding liquid-dye tank 45; and semiconductor laser chips 48 (laser light sources) each attached to a support plate 49 fixed to the base plate 44 to irradiate the gasifying unit 47 with a laser beam L. This print head 40 is the same in construction as that shown in FIG. 13.

A check valve 54 is disposed so as to close a dye passage 53 connecting the powdered-dye tank 41 and the liquid-dye tank 45. Each liquid-dye tank 45 is provided therein with a dye feed element 55, such as a vibrator, opposite to the corresponding gasifying unit 47 to urge the liquid dye 62 toward the gasifying unit 47. The dye feed element 55 is a bimorphic element or a piezoelectric elements. The dye feed element 55 is dispensable. The check valve 54 closes the dye passage 53 when the dye feed element 55 applies pressure to the dye and opens the dye passage 53 when the dye feed element 55 applies negative pressure to the dye or the same is not in action. The powdered sublimable dye 61 contained in each powdered-dye tank 41 is heated an fused by the heater 46 while the check valve 54 is open and the liquid sublimable dye 62 is stored in the corresponding liquid-dye tank 45. Disposed within the gasifying pint 47*a* of each gasifying unit 47 are a light-transmissive, heat-resistant transparent layer 50 attached to the lower surface of the base plate 44, a light-to-heat conversion layer 51, which absorbs a laser beam L and converts the light energy of the laser beam L into thermal energy, formed on the lower surface of the heat-resistant transparent layer 50, and a liquid-dye holding layer 52 containing beads to hold the liquid sublimable dye 62 by capillary effect.

The heat-resistant transparent layer 50 is a transparent film capable of withstanding high heat of 180° C. or above and having a thermal conductivity of 1 W/m·°C. or below, a near infrared transmissivity of 85% or above (thickness: 10 μm), a specific heat of 2 J/g·°C. or below and a density of 3 g/cm$^3$ or below. The heat-resistant layer 50 is formed on the lower surface of the base plate 44. The light-to-heat conversion layer 51 is a polyimide film. The liquid-dye holding layer 52 is formed by forming a metal thin film over the lower surface of the light-to-heat conversion layer 51 and etching the metal thin film in a mesh.

In the laser sublimation color video printer 31, the powdered dye 61 contained in each powdered-dye tank 41 is heated to its melting point to fuse (liquidize) the same by the heater 46. The liquid sublimable dye 62 is supplied at a fixed high rate to the heat-resistant transparent layer 50, the light-to-heat conversion layer 51 and the liquid-dye holding layer 52 disposed in the gasifying pit 47*a* of the corresponding gasifying unit 47 by the feed action of the dye feed element 55 and capillary effect. When printing a color picture on the recording sheet 80, an image signal representing dots of one of the three colors on one printing line is supplied to the print head 40, and the light energy of the laser beam L emitted by each semiconductor laser chip 48 is converted into heat by the corresponding light-to-heat conversion layer 51. Consequently, each liquid sublimable dye 62 held by each liquid-dye holding layer 52 is gasified, are transferred in that order to the dye-accepting layer 80*a* of the recording sheet held between the flat platen 34 and the protective plates 43 to print a color picture.

Since each liquid-dye tank 45 is provided with the vibrating element 55, a moderate pressure can be applied to the liquid sublimable dye 62 contained in the liquid-dye tank 45 to supply the liquid sublimable dye 62 at a fixed high rate to the light-to-heat conversion layer 51 and the liquid-dye holding layer 52. Since the dye passage 53 connecting the powdered-dye tank 41 and the liquid-dye tank 45 is provided with the check valve 54, the reverse flow of the liquid sublimable dye 62 from the liquid-dye tank 45 into the powdered-dye tank cam be surely inhibited.

The heater 46 provided in the liquid-dye tank 45 heats the liquid sublimable dye 62 to maintain the sublimable dye in the liquid phase. The highly heat-resistant heat-resistant transparent layer 50 withstands continuous printing operation. A structure formed by laminating the light-to-heat conversion layer 51 and the heat-resistant transparent layer 50 withstands continuous use, has a high thermal conductivity, enables rapid thermal diffusion in the surface of the light-to-heat conversion layer 51 and the light-to heat layer 51 can be heated in a uniform temperature distribution even if the light energy in the laser beam L is not distributed uniformly in a distribution like a Gaussian distribution and, consequently, uniform transfer of the dye can be achieved.

Since the liquid-dye holding layer 52 is formed on the light-to-heat conversion layer 51, the liquid-dye holding layer 52 is formed by etching the metal thin film in a mesh having grooves arranged at an appropriate pitch and having an appropriate depth, the liquid-dye holding layer 52 is able to hold always an appropriate amount of the liquid sublimable dye 62 and, consequently, an appropriate amount of the liquid sublimable dye 62 necessary for printing can be gasified by the light-to-heat conversion layer 51. Since the liquid-dye holding layer 52 is formed directly on the light-to-heat conversion layer 51 to omit an adhesive layer, the heat capacity of the print head is smaller than that of an equivalent print head provided with an adhesive layer by the heat capacity of the adhesive layer and, consequently, the print head operates at a comparatively high thermal efficiency.

The mode of transfer of the gasified sublimable dye from the light-to-heat conversion layer to the recording sheet will be described hereinafter. The laser beam L instantaneously emitted by each semiconductor laser chip 48 travels through the glass base 44 and the heat-resistant transparent layer 50 and reaches the light-to-heat conversion layer 51, and then the light energy of the laser beam L is converted into corresponding thermal energy by the light-to-heat conversion layer 51. The heat-resistant transparent layer 50 is caused to expand suddenly as shown in exaggerated views in FIGS. 15(*e*) to 15(*g*) by the heat generated by the light-to-heat conversion layer 51 to give kinetic energy to the liquid sublimable dye 62 so that the liquid sublimable dye 62 flies toward the dye-accepting layer 80*a* of the recording sheet 80 as shown in FIG. 15(*g*). Consequently, an amount of the gasified sublimable dye 63 proportional to that of the heat is transferred to the dye-accepting layer 80*a* of the recording sheet 80 as shown in FIG. 15(*h*)in a desired density to form a picture having a desired gradation.

In FIG. 15(*g*), $\phi_1$ (=100 μm) is the diameter of a spot formed by the laser beam L, and $\phi_2$ (=60 to 80 μm) in FIG. 15(*h*) is the diameter of a dot (picture element). Thus, the yellow, magenta and cyan gasified sublimable dyes 63 are transferred sequentially in that order to the dye-accepting layer 80*a* of the recording sheet 80 held between the flat platen 34 and the protective plates 43 to print a color picture. A heat-resistant transparent layer 50 formed of an aromatic polyamide has an excellent heat-resistant property and is capable of withstanding continuous use. The printing apparatus thus constructed is capable of stably and satisfactorily printing pictures by using the mixtures each of a surface active agent and a dye, or dyes having boiling points not higher than their decomposition temperature.

Figure 16:
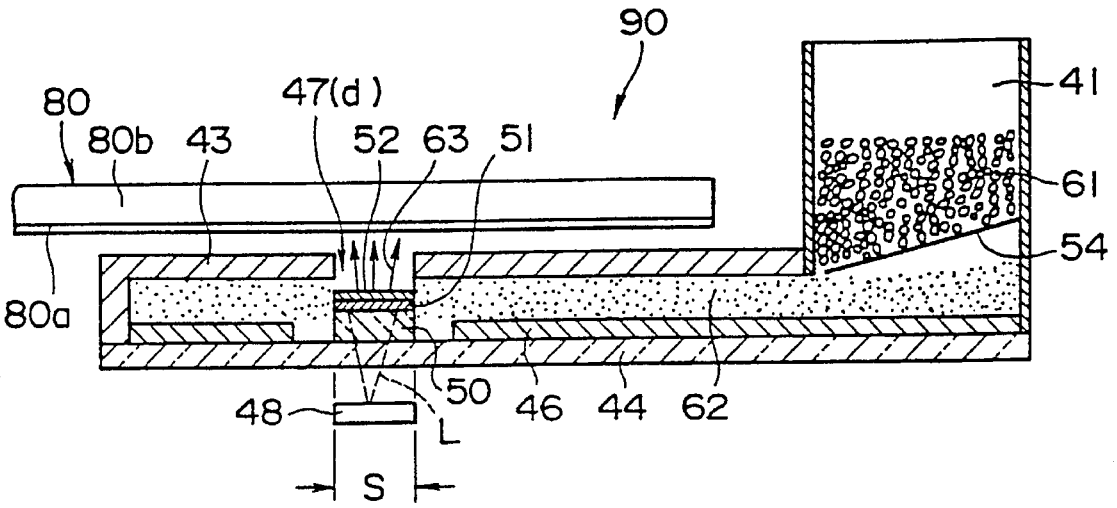
FIG. 16 is a sectional view of a print head included in a printing apparatus in another embodiment according to the present invention.
Figure 17:
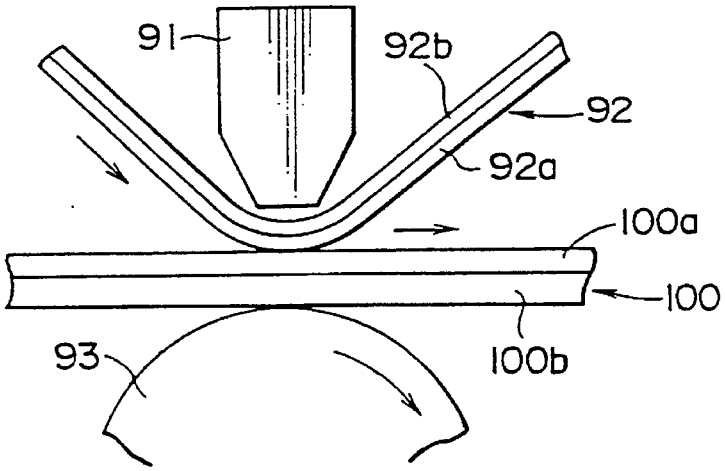
FIG. 17 PRIOR ART
FIG. 17 is a front view of an essential portion of a printing apparatus provided with a conventional thermal print head.

Although the laser beam is emitted by the semiconductor laser chip disposed above the print head to print pictures on the recording sheet under the print head in the example shown in FIGS. 11 to 13, the respective positions of the semiconductor laser chip and the recording sheet may be reversed as shown in FIG. 16. A print head 90 shown in FIG. 16 has a base plate 44 provided with a heater 46, and heats the powdered dye 61 supplied from each powdered-dye tank 41 by the heater 46 to obtain the liquid sublimable dye 62. A heat-resistant transparent layer 50, a light-to-heat conversion layer 51 and a liquid-dye holding layer 52 are formed in that order in a laminated structure on the base plate 44. A semiconductor laser chip 48 is disposed under the babe plate 44. A laser beam L emitted by the semiconductor laser chip 48 is focused on liquid dye held by a liquid-dye holding layer 52 included in a gasifying unit 47 to gasify the liquid dye in order that the gasified dye is transferred from the gasifying unit 47 to the dye-accepting layer 80*a* of a recording sheet 80 held over the print head 90. The print head 90 is the same in components and construction as the print head 40 shown in FIG. 11. Desirably, the light-to-heat conversion layer 51 is not formed of a polyimide resin. The light-to-heat conversion layer 51 is a Ni/Co alloy thin film formed by evaporation or sputtering over a heat-resistant transparent layer 50 and having a near infrared transmissivity of 0.9 or above, a thickness of 1 μm or below, a specific heat of 0.5 J/g·°C. or above, a thermal conductivity of 20 W/m·°C. or above and a density of 20 g/cm$^3$ or below. The area of the Ni/Co alloy thin film may be equal to the area S shown in FIGS. 11 and 16 in which the gasified dye is printed. Thus, the heat resistance of the light-to-heat conversion layer is enhanced to enable the continuous use of the same. Having a very small thickness, the Ni/Co alloy thin film has a comparatively small heat capacity, and the light-to-heat conversion layer is heat-insulated by the liquid dye surrounding the same to improve the thermal efficiency. The powdered dye may be directly gasified, i.e., sublimated, for printing by irradiating the same With the laser beam instead of liquidizing the powdered dye and gasifying the liquid dye.

Although the intention has been described specifically in terms of the preferred embodiments thereof, many modifications and variations of the present invention are possible in the light of the above teachings. For example, the printing layer and the print head may have may be formed in construction and shape other than those described above, and the materials of the components of the print head may have may be other than those described above. The printer of the present invention may be used for printing monochromatic color pictures or black-and-white pictures instead of printing full-color pictures using yellow, magenta and cyan dyes. The fusible dyes may be gasified or sublimated by using the energy of, for example, electromagnetic waves or electric discharge from styluses instead of the energy of a laser beam. A noncontact thermal print head may be employed instead of the foregoing print heads.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. In a thermal transfer printing method wherein a dye provided on a printing sheet is selectively heated by a print head at a printing station and transferred to a recording medium spaced from the printing sheet, the improvement comprising:

using as the dye a binderless dye composition comprising: a sublimable dye having a boiling point less than its decomposition temperature and from about 0.001 to about 10% by weight, based on the weight of the dye composition of a surface active agent.

2. A method as defined in claim 1, wherein in said dye composition the sublimable dye has a boiling point of from about 50° to about 600° C.

3. A method as defined in claim 1, wherein in said dye composition, the sublimable dye has a boiling point of from about 250° to about 450° C.

4. A method as defined in claim 1, wherein in said dye composition, the sublimable dye is selected from the group consisting of quinophthalone dyes, anthraquinone dyes and dyes containing dicyanostyryl groups.

5. A method as defined in claim 1, wherein in said dye composition, the surface active agent is selected from the group consisting of anionic surface active agents, cationic surface active agents, nonionic surface active agents and silicone surface active agents.

6. A method as defined in claim 1, wherein in said dye composition the surface active agent is an anionic surface active agent selected from the group consisting of fatty acids having 6 to 24 carbon atoms, alkali salts of fatty acids having 6 to 24 carbon atoms, higher alcohol ester phosphate salts and higher alcohol sulfonates.

7. A printing method comprising the steps of:

providing a continuous printing medium including a substrate having a surface and a sublimable dye layer disposed on said surface;

providing a printing station having an associated print head capable of generating heat;

providing a recording medium at the printing station in spaced adjacent relation to said print head;

passing said printing medium through said printing station adjacent said print head so that said dye layer faces said recording medium and is spaced from the recording medium by a distance of from about 1 to about 100 μm;

using the printing medium to selectively heat dye in said dye layer to thereby transfer dye from the printing medium to the recording medium;

moving the printing medium so that a previously heated portion of the printing medium is outside of the printing station; and thereafter, replenishing dye to said dye layer by passing a previously heated portion through a dye supply unit, contacting the dye layer of the previously heated portion with powdered dye and heating the printing medium opposite the dye layer to fuse the powdered dye to the previously heated dye layer, thereby replenishing the dye layer for continuous use.

* * * * *